US008850948B1

(12) United States Patent
Coats

(10) Patent No.: US 8,850,948 B1
(45) Date of Patent: Oct. 7, 2014

(54) PERSONAL BALLISTIC SHIELD

(71) Applicant: James Coats, Gainesville, FL (US)

(72) Inventor: James Coats, Gainesville, FL (US)

(73) Assignee: Phalanx Defense Systems LLC, Gainesville, FL (US)

( * ) Notice: Subject to any disclaimer, the term of this patent is extended or adjusted under 35 U.S.C. 154(b) by 1 day.

(21) Appl. No.: 13/908,014

(22) Filed: Jun. 3, 2013

(51) Int. Cl.
*F41H 5/08* (2006.01)
*F41H 5/04* (2006.01)
*F41H 1/02* (2006.01)

(52) U.S. Cl.
CPC ..... *F41H 1/02* (2013.01); *F41H 5/0478* (2013.01)
USPC ..... 89/36.02; 89/914

(58) Field of Classification Search
CPC ..... F41H 5/08; F41H 5/0478
USPC ..... 89/36.05, 36.01, 36.02, 921, 922, 926, 89/914, 918, 939; 2/2.5; 428/121, 911
See application file for complete search history.

(56) References Cited

U.S. PATENT DOCUMENTS

| | | | | |
|---|---|---|---|---|
| 4,292,882 | A * | 10/1981 | Clausen | 89/36.02 |
| 5,360,655 | A * | 11/1994 | McDonald | 428/121 |
| 6,887,554 | B2 * | 5/2005 | Widlund et al. | 428/121 |
| 8,597,761 | B2 * | 12/2013 | Formon et al. | 428/124 |
| 2010/0313321 | A1 | 12/2010 | Carlson | |
| 2012/0291621 | A1 * | 11/2012 | Sayre et al. | 89/36.02 |

* cited by examiner

*Primary Examiner* — Reginald Tillman, Jr.
(74) *Attorney, Agent, or Firm* — Sven W. Hanson

(57) ABSTRACT

A novel device and method provides personal protection from ballistic weapons such as handguns and rifles. A single piece of high-strength ballistic fabric that may be cut from a bulk roll by a single cutting step is folded in layers over and around multiple separate sheets of vinyl to produce a ballistic resistance assembly. The device may be incorporated into personal articles such as garments.

17 Claims, 6 Drawing Sheets

PERSONAL BALLISTIC SHIELD

BACKGROUND OF THE INVENTION

The present invention pertains to portable shields to be used as personal protection against the most typical civilian handguns and rifles. There have been many recent advances in the technology of resisting the impact and consequent damage from incident ballistic penetrators. Much of the technology has been directed at using complex assemblies of high-strength fabric layers or metallics or ceramics. This is partially due to the desire to resist ballistic weapons having ever-increasing energy, power and penetrating capacity seen in the law-enforcement and military fields. Because of this focus, what has been perceived as acceptable product monetary costs are too high for consumer use products and markets. Consequently, few of these products are available to the public for personal use. What is needed is a personal shield that is both very portable and also low cost.

SUMMARY OF THE INVENTION

The present invention is a device and method for providing personal protection from ballistic weapons such as handguns and rifles. The invention uses a construction that allows use of relatively low cost materials and methods of assembly to enable production at reduced cost. Particularly the invention uses a single piece of high-strength ballistic fabric that may be cut from a bulk roll by a single cutting step. The single piece is preferably a simple rectangle shape. The ballistic fabric piece is folded in layers over and around multiple separate sheets of a highly-elastic material that may be vinyl or similar materials. No interconnections between the ballistic fabric layers and highly-elastic material sheets are used, nor are such necessary or suggested. The cooperating characteristics of the high-strength ballistic fabric and the highly-elastic material provides a high level of resistance to penetration from ballistic penetrators.

Particular embodiments of the invention include various different personal articles that include an enclosure containing a ballistic panel according to the invention. The panel is formed of a single contiguous sheet of ballistic fabric folded around at least two rectangular portions of vinyl sheet material. These are arranged such that the ballistic fabric provides at least twelve parallel layers of the ballistic fabric and the vinyl sheets are each covered with a single respective outermost layer of ballistic fabric. In alternative configurations, a third vinyl sheet is added to increase The invention includes garments or other portable or personal articles that include a ballistic panel according to the invention.

The invention includes methods of constructing personal ballistic protection devices that reduce costs from prior art devices particularly directed at military or police personnel use. At the same time, the present device has particular benefits and value for military or police personnel protection. Additional novel aspects and benefits of the invention will be discerned from the following description of particular embodiments and the accompanying figures.

DETAILED DESCRIPTION OF EMBODIMENTS OF THE INVENTION

Figure 1:
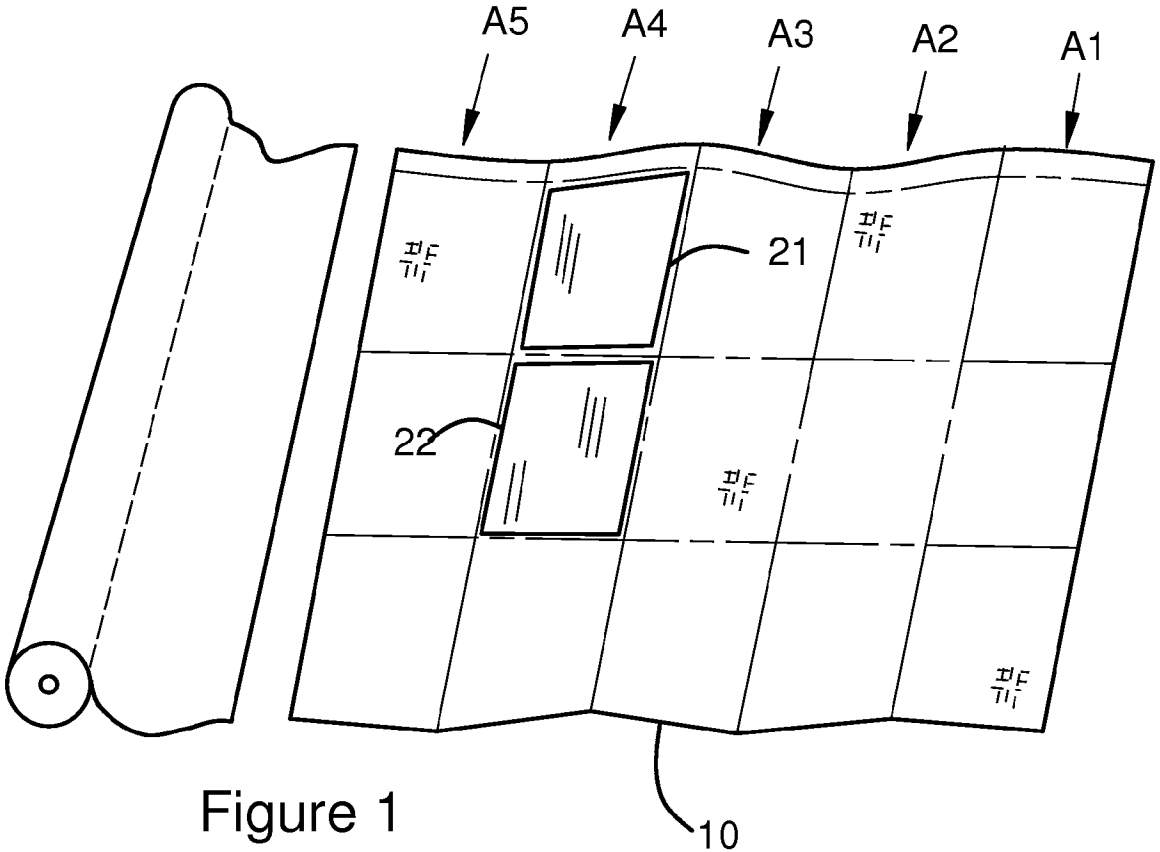
FIG. 1 depicts the components of the inventive ballistic shield prior to assembly.

FIGS. 1, and 2A to 2E depict the steps in an inventive method of forming a ballistic panel (FIG. 2E) according to the invention. The method and panel are designed to be easily formed with a minimum of operations and effort.

The inventive ballistic panel 99 is formed of a single contiguous sheet 10 of flexible sheet ballistic material and two or more rectangular sheet pieces 21, 22 of relatively lower-strength, highly-elastic (HE) sheet material. The ballistic material may comprise any of various materials, but is preferably of woven sheet material formed of Kevlar fibers (Trademark of E. I. du Pont de Nemours and Company). An acceptable ballistic fabric is constructed of the Kevlar aramid fiber in a 3000 denier plain weave (17×17 warp/fill) having a weight of 13.7 ounces per square yard (465 grams/square meter). Other woven and nonwoven ballistic fabrics having similar flexibility and ballistic properties are also available and contemplated for the same use. For that purpose herein, the term "ballistic fabric" means flexible sheet-like materials having tensile strength and toughness properties approximating Kevlar fibers and fabric. The function of the ballistic sheet 10 is to resist penetration of ballistic projectiles through the assembled panel 99.

The function of the HE sheets is to increase the time and distance duration of the impact of an incidental ballistic projectile onto the ballistic material and thereby distribute impact energy to an increased area and volume of the ballistic panel 99. For this purpose, in all cases, each of the HE material sheet pieces 21, 22 are located under (behind) at least one layer of ballistic material and in front of (relative to projectile movement) a majority of ballistic material layers. Preferably, the HE material is flexible sheet vinyl (poly vinyl chloride) having an ultimate elongation of at least 350 percent and a brittle temperature of about −38 (minus 38) degrees C., with a tensile strength of 2400 PSI (pounds/sq.inch). While strength may vary significantly and still satisfy the requirements of the invention, the minimum elongation property must be substantially maintained to provide the ballistic impact attenuating and dampening effect of the HE material when combined with the ballistic fabric. Herein, this HE property defines, for the inventive purposes, a highly-elastic material. The term "vinyl" herein further means the group of sheet materials commonly referred to as polyvinylchoride and having substantially the above properties, and also includes similar materials having the same or similar compositions or having substantially equivalent properties and characteristics. Such materials may include materials not typically referred to as vinyl.

The thickness of the HE material is critical. The thickness of the HE pieces 21, 22 determines the distance into the panel 99 that an incident ballistic projectile travels while at the same time dispersing energy into the covering high strength ballistic material. For this reason, the HE material must be more than a minimum thickness to allow this interaction to occur.

However, the HE material thickness must also not be too great. Beyond a maximum thickness, inner HE layers will not become involved in the energy dissipation until an incident projectile has passed through the outer ballistic layer. With a proper HE material thickness, the layers of the ballistic sheet are linked by the HE material and act in concert, rather than independently and sequentially, in their interaction with an incident projectile. For this reason, the HE material has a preferred thickness of 0.160 inches (4 millimeters). HE material having a thickness in the range of 0.040 to 0.160 inches (1 to 4 millimeters) will substantially improve penetration resistance over that of ballistic material alone.

In FIG. 1, the ballistic material sheet 10 is depicted as cut and separated from a roll 100 of like ballistic fabric material. This demonstrates that the current invention and method are designed to allow forming an effective ballistic sheet 10 from a roll of continuous sheet material by way of a single transverse cut. This is valuable in that effective ballistic materials have high strength and durability and cutting and forming these fabrics are difficult and expensive processes in terms of equipment and process requirements. Using the methods herein, an effective ballistic panel may be formed from stock rolled ballistic fabric having a width of about 56 inches (1.42 meters). The result is that the sheet 10 has a rectangular shape.

In FIG. 1, the ballistic sheet 10 is depicted with phantom orthogonal fold lines defining various subpanels A1 to A5. These are illustrated for convenience here in describing the method and manner of manipulating the ballistic sheet 10. It should be clear that the ballistic sheet 10 is in no way or form physically divided or partitioned into separate or distinct pieces.

Two HE pieces 21, 22 are shown placed in parallel contact with the ballistic sheet 10 in the necessary relative locations. The sides of the HE pieces 21, 22 are parallel to the side edges of the ballistic sheet 10. Generally, in any particular size and configuration of the inventive panel, the location of the HE pieces 21, 22 will be easily determined by the desired final size. The HE pieces may be conveniently provided in rectangular shape with width and height dimensions of 12 and 18 inches (30.5 to 45.7 cm) respectively to form a preferred panel 99 for use in shielding a human body.

In the configuration shown, the two HE pieces 21, 22 are adjacent and aligned on a common subpanel A4. Overhanging sections 11, 12 (generally bounded by the fold lines under and above the HE pieces 21, 22) of the ballistic sheet 10 extend respectively above and below the HE pieces 21, 22. It should be clear that the timing of placing the HE pieces 21, 22 is not critical.

Figure 2A:
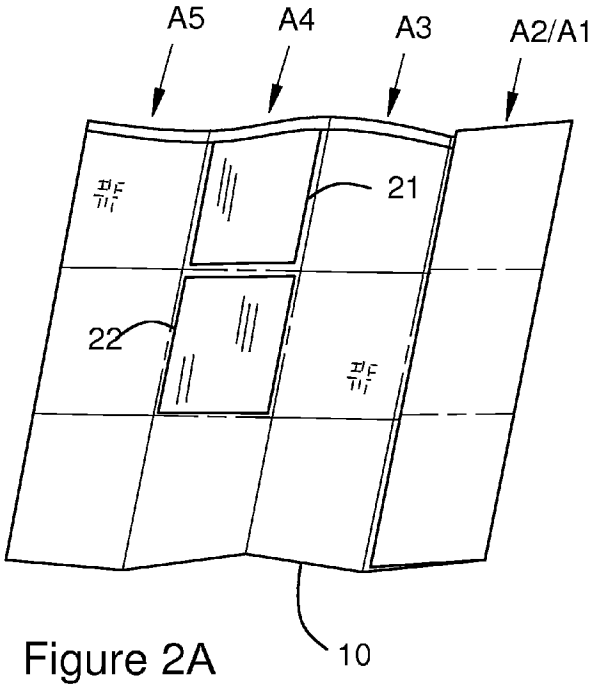
FIGS. 2A to 2E depict the steps in folding a ballistic sheet to form the inventive shield.
Figure 2B:
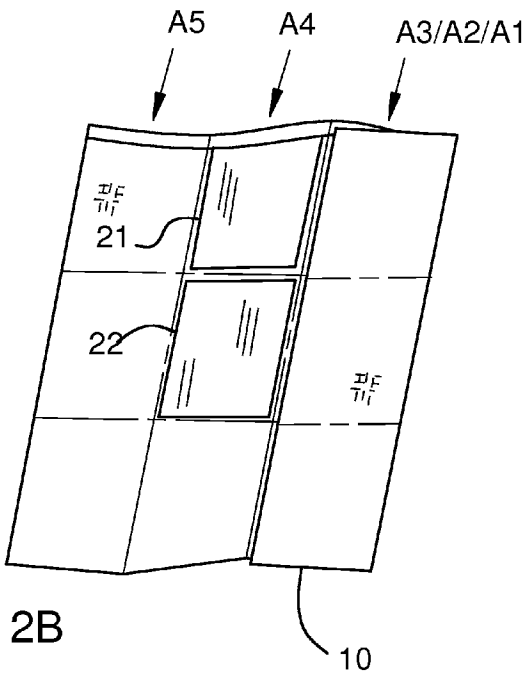
Figure 2D:
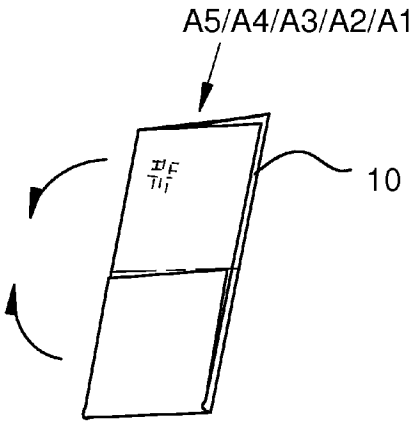
Figure 3:
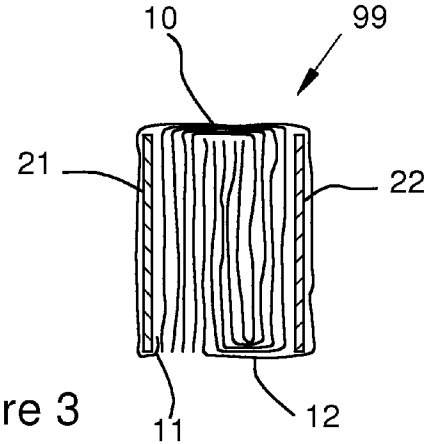
FIG. 3 is a cross-section view of the assembled inventive shield.
Figure 2C:
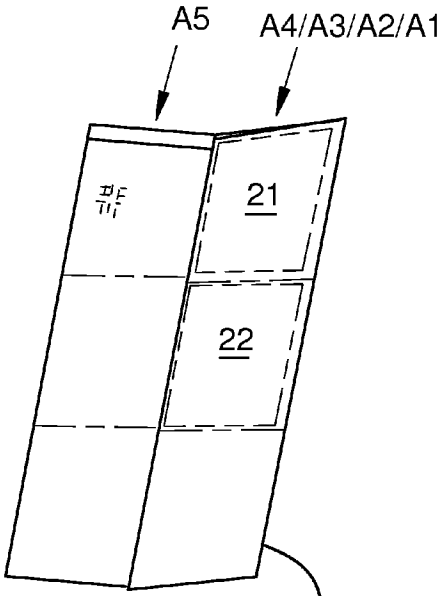
Figure 2E:
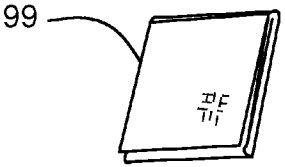

FIGS. 2A and 2B depict how the first overhanging section 11 is folded over the upper HE piece 21, and subsequently the first subpanels A1, A2 are folded along the fold lines to overlay subpanel A3. In FIG. 2C, these three together are folded over the adjacent subpanel A4 together with the HE pieces 21, 22 (shown in hidden-dashed line). In FIG. 2D, the final subpanel A5 is then folded over the folded assembly and the bottom overhanging section 12 (folded) is then folded over the lower HE piece 22. In the condition in FIG. 2D, it should be clear that the upper HE piece 21 is covered by four layers of the ballistic sheet 10 formed by the overlapping subpanels. At the same time, the lower HE piece 22 is covered by nine layers of the ballistic sheet 10. When then ballistic sheet 10 is folded to bring the two HE pieces in overlapping configuration as shown in FIG. 2E, the two HE pieces are separated by the combined thirteen layers of the ballistic sheet 10 and covered on their outer faces by one layer, each, of the ballistic sheet 10. This order can be seen in FIG. 3, which is a cross-section view of the panel 99. In FIG. 3, the adjacent layers are shown spaced apart for clarity.

The above manner of assembly provides a combination that secures the HE pieces 21, 22 within the folded ballistic sheet 10 without fasteners or other fastening devices or methods. This allows the panel 99 to be easily and cheaply handled for combining or assembly with other articles such as user garments.

It is critical that the HE pieces 21, 22 have at least one layer of the ballistic sheet 10 located outside, surrounding the HE pieces. That is, the HE pieces must be contained entirely contained within the folded ballistic sheet 10. This is required because the effectiveness of the HE pieces in resisting, in their combination with the multiple inner ballistic sheet layers, penetration by ballistic projectiles is dependent on the outer strength of the outer ballistic sheet 10 layer to disperse or distribute the projectile energy into a greater area and volume of the HE.

At the same time, it is the lower strength and high elongation properties of the HE material that increases the effectiveness of the invention. When adjacent layers of high-strength ballistic material are separated by a thickness and volume of material in the nature of the HE material, the combined layers and HE material are linked and cooperate in a synergetic manner to enable greater absorption and dispersion of ballistic projectile energy. This is in comparison to the combined capacities of similar ballistic layers which act independently or are combined in a rigid structure in which the penetration event occurs more quickly relative to the properties of the structure.

Figure 4C:
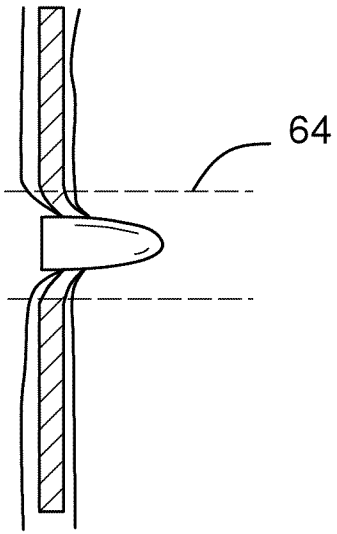
FIGS. 4A to 4C depict the interaction of an incident ballistic projectile with the first layers of the inventive shield.
Figure 4B:
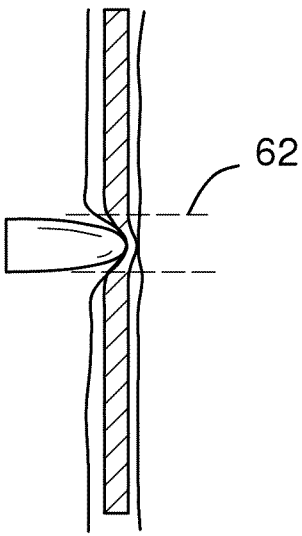
Figure 4A:
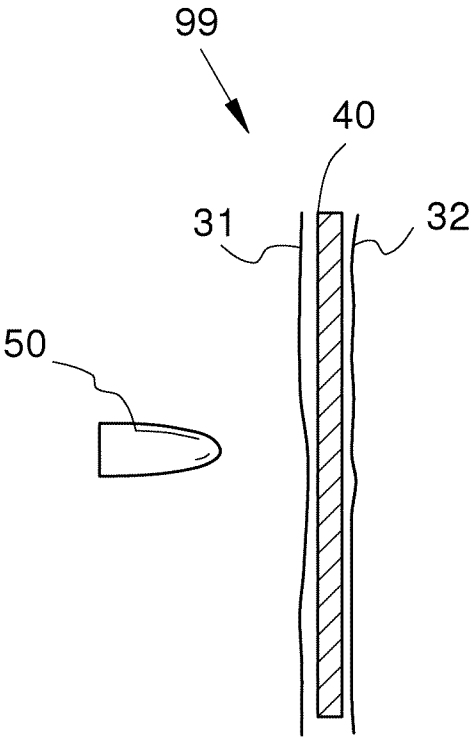

The cooperation of the ballistic sheet layers and the HE material is illustrated in FIGS. 4A to 4C respecting an incident ballistic projectile. FIG. 4A depicts the outer portion of the inventive shield in a configuration similar to that in the prior illustrations. Only the outermost ballistic sheet layers 31, 32 and one HE layer 40 are included for clarity of this discussion. In FIG. 4B, a traveling projectile 50 is shown at its initial contact with the panel 99. The zone of its physical interaction 62 with the ballistic sheet layers 31, 32 and HE layer 40 is illustrated.

Typically, in rigid shield constructions in the prior art, energy dissipation is greatly limited to a similar limited area due to the fact that the shield is unable to dynamically respond to the projectile due to those shields' own stiffness.

FIG. 4C illustrates an increased deflection and distortion of the outer ballistic sheet layer 31 and the HE layer 40, due to the high flexibility of the panel construction and the lack of interlayer connectivity that allows in-plane as well as out-of-plane displacement of the layers 31, 32. An enlarged zone of interaction 64 in the panel 99 provides an increased area and volume of high strength material in the ballistic layer 31 that absorbs and dissipates the energy of the projectile. This enlarged zone 64 is a consequence of the relatively low strength yet high elongation of the HE material that allows the outer layer 31 to deflect rather than disrupt or fail during initial passage of the projectile. Flexibility is critical and high-strength interconnectivity between the layers of the panel 99 will defeat the performance of the device.

TESTING: The enlarged zone 64 was observed during testing of prototype panels constructed according to the above description. To quantify the performance of the inventive panels, a standard backface deflection test was performed using typical ballistic projectiles of interest. A prototype panel constructed according to the above description. The panel was supported in front of a clay test bed following established methods for measuring backface deflection against simulated human body structure. In calibration, the clay test bed had an average 19 millimeter drop deflection at a clay test temperature of 90 degrees C. Six conventional .44 caliber magnum cartridges with 240 grain bullets were discharged to impact the prototype panel in a closely-spaced pattern generally about the center of the panel. The average measured bullet velocity was 1380 feet per second. The backface deflection of the panel after impact was measured following standard procedures. The measured backface deflection of the panel was 23 millimeters (perpendicular to the plane of the back surface of the panel). This compares to a reported industry backface deflections of 44 millimeters for conventional personal armor devices and a single shot from similar weapons. The results demonstrate a substantial improvement over conventional personal armor.

The sequence and manner of folds illustrated in the figures are not unique and alternative arrangements and configurations may be used to arrive at a result equivalent to that shown. Such alternatives may differ in where the folds are located as shown in FIG. 3.

Figure 6:
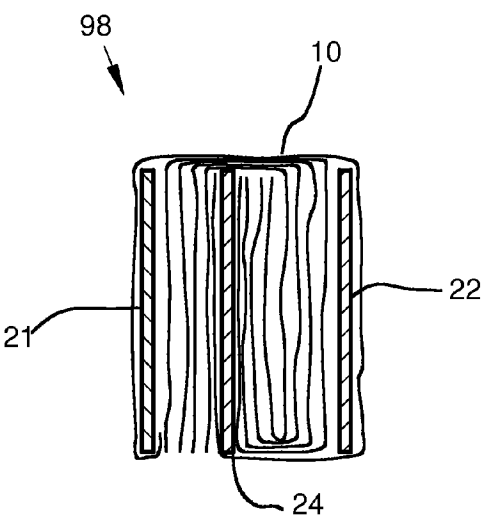
FIG. 6 is a cross-section view of the assembled components shown in FIG. 5.
Figure 5:
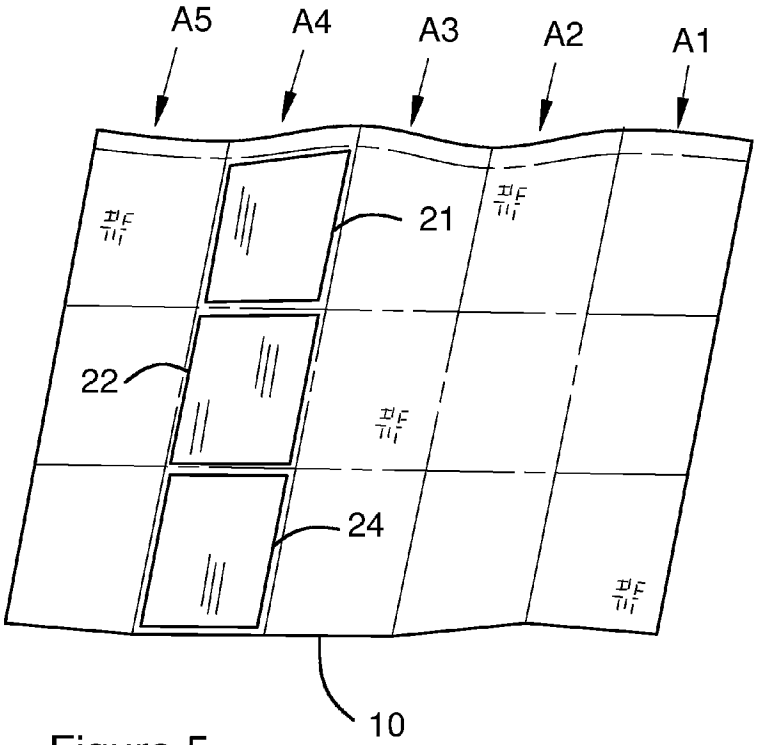
FIG. 5 illustrates the components of an alternative configuration of the invention.

In addition, additional HE pieces may be introduced for additional penetration resistance. For example, a third HE piece 24 may be located over the lower overlapping section 12 in one of the subpanels, and the same fold sequence as above followed. The initial ballistic sheet 10 and HE pieces are illustrated in an alternative configuration in FIG. 5. The same folding pattern and process as described above may be followed. The result will be that the added HE piece 24 will be between the HE pieces 21, 22 in the assembled panel 99 as seen in FIG. 6. This option and addition does not alter the function of and benefits provided by the embodiment shown.

In all configurations it is greatly preferred that at least two HE layers be used with each one of the two located adjacent, immediately within, one of the two outer-most faces of the finished panel 99. This symmetric configuration ensures that effectiveness of the panel is not dependent on the orientation of the panel 99 or manner of its combination with any other article. While the benefit and function of the single HE material piece that is presented to an incident projectile may be substantially provided without the second (backside) HE layer, maintaining the symmetric configuration with the backside HE layer is suggested.

In the configuration illustrated, the resulting assembled panel 99 includes 15 parallel portions of the ballistic sheet 10. This is a preferred configuration that is effective for the intended purpose while using relatively low-cost aramid fiber ballistic fabric material. Depending on the anticipated energy and velocity of the ballistic weapon to be resisted, and the particular materials of construction, the inventive panel may include any number in the range of twelve to twenty-four, inclusive, (12 to 24) layers of ballistic fabric. In all cases, the number of layers is provided by appropriate sizing and folding of a single contiguous sheet of ballistic material.

Figure 7:
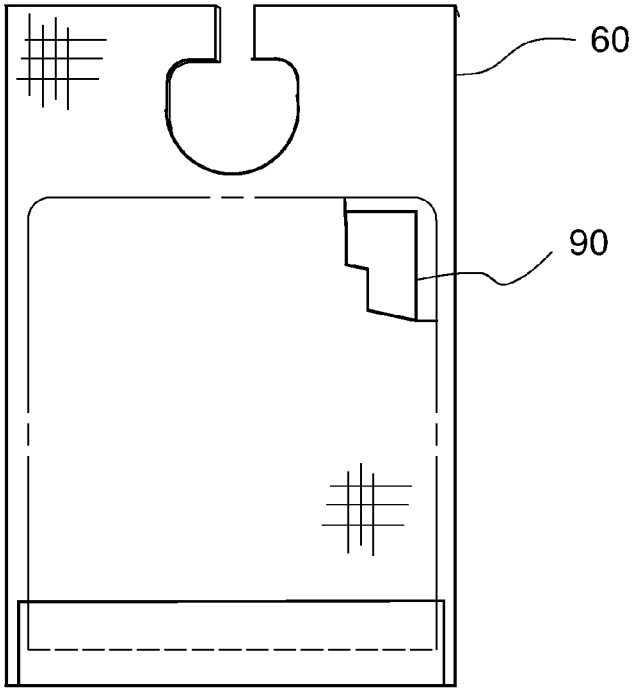
FIG. 7 depicts a person article incorporating the inventive shield.

Preferably, in use the panel 99 is covered in an envelope of convenient plastic or cloth material in order to maintain the construction of the panel assembly. The envelope need not have any particular strength and is not relied on for ballistic resisting properties of the invention. In use, the covered panel may be inserted into an appropriated located and sized enclosure formed on or in a useful portable article. Such an article may be a garment, backpack, luggage, personal article or secured to or integrated into a vehicle component. In FIG. 7, the article is a personal vest 60 configured to be worn about a person's neck to align an integral enclosure 31 over the upper torso of the person. The enclosure included an openable bottom to allow a covered panel 90 to be inserted for use or removed.

In other embodiments of the invention, an article may incorporate multiple panels 99 to increase ballistic protection or provide protection in other geometries, or provide protection against other forms of ballistic threats. For example, each of multiple person vests 60 may include interlocking structure or devices that allow the multiple vests (and their associated panels) to be interconnected to arrange and retain multiple panels 99 in three-dimensional configurations. Alternatively, a shield may be constructed particularly for modular interconnectivity in 2-D or 3-D forms. Multiple panels or shields according to the invention may be joined by interconnection to form a protective barrier, for various purposes, including, for example, isolating an explosive device and thereby protecting adjacent person. Similarly, multiple inventive panels 99 may be integrated into an single ballistic protection device.

The preceding discussion is provided for example only. Other variations of the claimed inventive concepts will be obvious to those skilled in the art. Adaptation or incorporation of known alternative devices and materials, present and future is also contemplated. The intended scope of the invention is defined by the following claims.

The invention claimed is:

1. A personal protection device comprising:
a portable article including an enclosure;
a single contiguous sheet of ballistic fabric;
at least two rectangular portions of highly-elastic sheet material; and
the sheet of ballistic fabric is arranged in folds about the portions of highly-elastic material to form an assembly comprising at least twelve parallel layers of the ballistic fabric and wherein two of the portions of highly-elastic material are each covered with a single respective outermost layer of ballistic fabric; and
the assembly is removably disposed within the enclosure.

2. A device, according to claim 1, and wherein:
the at least twelve layers comprises between 12 and 24 layers.

3. A device, according to claim 2, and wherein:
the at least twelve layers comprises 15 layers.

4. A device, according to claim 1, and wherein:
the ballistic fabric comprises aramid fibers.

5. A device, according to claim 1, and wherein:
the portions of highly-elastic sheet material comprise polyvinylchloride and have a thickness dimension in the range of 1 to 4 millimeters.

6. A device, according to claim 1, and wherein:
the portable article is a garment.

7. A device, according to claim 1, and wherein:
the portable article is a backpack.

8. A device, according to claim 1, and wherein:
the portions of highly-elastic sheet material comprises three portions of polyvinylchloride, each having a thickness dimension of four millimeters.

9. A personal protection device comprising:
a single contiguous sheet of ballistic fabric;
at least two rectangular portions of vinyl sheet material; and wherein
the sheet of ballistic fabric comprises at least twelve layers folded between and over the portions of vinyl such that the ballistic fabric layers and vinyl material cooperate to provide substantial resistance to penetration by incident ballistic penetrators.

10. A device, according to claim 9 and wherein:
the vinyl sheet material has a thickness dimension in the range of 1 to 4 millimeters.

11. A device, according to claim 10, and wherein:
the vinyl sheet material comprises three portions.

12. A device, according to claim 9, and wherein:
the at least twelve layers comprises between 12 and 24 layers.

13. A device, according to claim 9, and wherein:
the ballistic fabric comprises aramid fibers.

14. A device, according to claim 9, and further comprising:
a portable article including an enclosure; the folded ballistic material and vinyl portions disposed in the enclosure.

15. A device, according to claim 14, and wherein:
the portable article is a garment.

16. A device, according to claim 14, and wherein:
the portable article is a backpack.

17. A method of forming a personal protection device comprising:
providing a single contiguous rectangular sheet of ballistic material;
placing at least two portions of sheet vinyl onto the ballistic material;
folding the ballistic material to surround and retain the vinyl portions within a folded ballistic material assembly in a configuration such that the ballistic fabric layers and vinyl material cooperate to provide substantial resistance to penetration by incident ballistic penetrators.

* * * * *